US011267536B2

(12) United States Patent
Alirol

(10) Patent No.: US 11,267,536 B2
(45) Date of Patent: Mar. 8, 2022

(54) FLOATS WITH LEVELING BALLAST MATTER CHAMBERS

(71) Applicant: Matthieu Alirol, The Dalles, OR (US)

(72) Inventor: Matthieu Alirol, The Dalles, OR (US)

( * ) Notice: Subject to any disclaimer, the term of this patent is extended or adjusted under 35 U.S.C. 154(b) by 93 days.

(21) Appl. No.: 16/868,102

(22) Filed: May 6, 2020

(65) Prior Publication Data

US 2021/0347445 A1 Nov. 11, 2021

(51) Int. Cl.
*B63B 22/20* (2006.01)

(52) U.S. Cl.
CPC ..... *B63B 22/20* (2013.01)

(58) Field of Classification Search
CPC ..... B63B 22/00; B63B 22/18; B63B 22/20; B63B 35/00; B63B 35/34; B63B 35/58; B63B 39/00; B63B 39/02; B63B 2207/00; B63B 2207/02
USPC ..... 114/121, 123, 124, 125, 264, 266, 267; 441/1, 28, 29, 35, 37
See application file for complete search history.

(56) References Cited

U.S. PATENT DOCUMENTS

| | | | | |
|---|---|---|---|---|
| 3,299,846 | A | 1/1967 | Jarlan | |
| 4,155,323 | A | 5/1979 | Finsterwalder | |
| 4,270,232 | A | 6/1981 | Ballew | |
| 6,571,789 | B1 | 1/2003 | Mora | |
| 8,099,804 | B2 | 1/2012 | Gregg | |
| 8,342,352 | B2 | 1/2013 | Alirol | |
| 10,029,931 | B2 * | 7/2018 | King | B01F 1/0027 |
| 2002/0086605 | A1 | 7/2002 | Cheung | |
| 2008/0000903 | A1 | 1/2008 | Cap et al. | |
| 2013/0092635 | A1 * | 4/2013 | King | B01F 3/12 210/754 |
| 2015/0059079 | A1 | 3/2015 | Alirol | |

FOREIGN PATENT DOCUMENTS

| | | |
|---|---|---|
| WO | 2005058730 | 6/2005 |

* cited by examiner

*Primary Examiner* — Daniel V Venne

(57) ABSTRACT

Floats including a central chamber, a peripheral chamber set, and a ballast matter. The peripheral chamber set is disposed around the central chamber in a substantially common plane with the central chamber. The peripheral chamber set defines circumferentially spaced sub-chambers. The ballast matter is disposed in either the central chamber or the sub-chambers of the peripheral chamber set. The float is buoyant and configured to float on an external liquid surface in a substantially horizontal plane. The ballast matter operates to maintain the center of gravity of the float proximate to the geometric center of the float when the float tilts relative to the horizontal plane.

20 Claims, 10 Drawing Sheets

FLOATS WITH LEVELING BALLAST MATTER CHAMBERS

BACKGROUND

The present disclosure relates generally to floating barriers, also known as floats. In particular, floats with leveling ballast matter chambers are described.

Known floats are not entirely satisfactory for the range of applications in which they are employed. For example, existing floats are prone to tilting and flipping over when subject to environmental factors like wind or waves. In addition, conventional floats can become stuck in a vertical orientation after being tilted by wind or waves. Floats designed to be horizontally oriented cover less area and are less effective as a barrier when they are stuck in a vertical orientation.

The limitations of conventional floats discussed above often result from ballast matter within the float being free to move within the floats and shifting the center of gravity to the periphery of the float. The unconstrained movement of ballast matter within the float often leads to the ballast matter collecting on one side of the float and shifting the center of gravity to one side of the float. The weight of matter collecting on one side of a float encourages the float to tilt downwards on the side where the matter has collected and to tilt upwards on the side the matter has vacated. The weight of the matter collected on one side of the float after it tilts can cause the float to become relatively stable in the tilted or vertical orientation.

Thus, there exists a need for floats that improve upon and advance the design of known floats. Examples of new and useful floats relevant to the needs existing in the field are discussed below.

Disclosure addressing one or more of the identified existing needs is provided in the detailed description below. Examples of references relevant to floats include U.S. Patent References: U.S. Pat. Nos. 3,299,846, 4,155,323, 4,270,232, 6,571,789, 8,099,804, and 8,342,352; and patent application publications 20080000903, 20020086605, 20150059079. The complete disclosures of the above patents and patent applications are herein incorporated reference for all purposes.

SUMMARY

The present disclosure is directed to floats including a central chamber, a peripheral chamber set, and a ballast matter. The peripheral chamber set is disposed around the central chamber in a substantially common plane with the central chamber. The peripheral chamber set defines circumferentially spaced sub-chambers. The ballast matter is disposed in either the central chamber or the sub-chambers of the peripheral chamber set. The float is buoyant and configured to float on an external liquid surface in a substantially horizontal plane. The ballast matter operates to maintain the center of gravity of the float proximate to the geometric center of the float when the float tilts relative to the horizontal plane.

DETAILED DESCRIPTION

Figure 1:
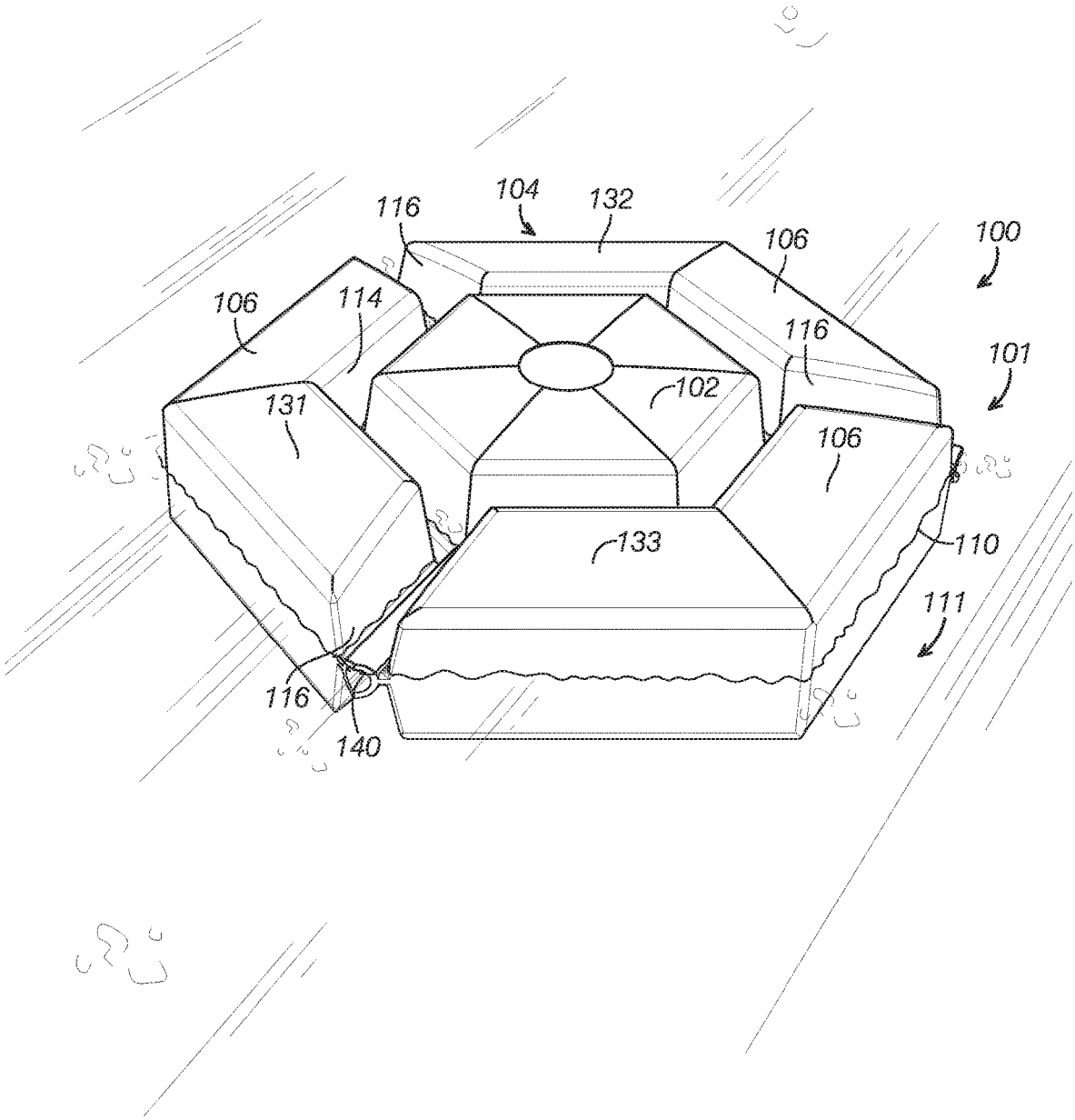
FIG. 1 is a perspective view of a first example of a float floating on an external liquid surface, the float having a central chamber and three sub-chambers disposed around the central chamber and floating on the external liquid surface at a height where external liquid flows into inlets and channels between the chambers.

The disclosed floats will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various floats are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example.

The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

The expressions "proximate to" and "relatively close" with regard to center of gravity discussions means the center of gravity of the float is close enough to the geometric center of the float to cause the float to return to the float's original horizontal orientation after tipping forces are removed rather adopt a vertical orientation.

Floats with Leveling Ballast Matter Chambers

With reference to the figures, floats with leveling ballast matter chambers will now be described. The floats discussed herein function to create a barrier and/or insulation layer on a liquid surface. The floats are configured to cooperate with a plurality of floats to substantially cover the surface of a liquid collectively. The floats are configured to naturally abut surrounding floats in a relatively close arrangement to collectively form a substantially complete cover for the liquid surface.

The floats functioning as a barrier help to keep animals, pests, foliage, or other debris out of a liquid. For example, the float barrier may discourage or avoid animals harming themselves by accessing a toxic liquid. Additionally or alternatively, the float barrier may discourage or avoid animals or pests contaminating a liquid by accessing it and introducing waste into the liquid. The float barrier may also limit evaporation of a liquid or release of fumes from the liquid. The floats functioning as an insulating layer can help maintain a desired temperature of a liquid.

The reader will appreciate from the figures and description below that the presently disclosed floats address many of the shortcomings of conventional floats. For example, the floats discussed herein resist tilting and flipping over when subject to environmental factors like wind or waves. In addition, the floats discussed in this document avoid becoming stuck in a vertical orientation after being tilted by wind or waves, which helps keep them in a horizontal orientation to cover more area and to be more effective as a barrier.

The floats discussed herein constrain how ballast matter may move within them. Constraining movement of ballast matter within the float avoids ballast matter collecting on one side of the float and shifting the center of gravity to the periphery. By maintaining the center of gravity towards the center of the float, the floats discussed in this document avoid the weight of ballast matter collecting on one side of a float and encouraging the float to tilt downwards on the side where the matter has collected and to tilt upwards on the side the matter has vacated. Maintaining a geometrically central center of gravity also avoids the weight of the matter collected on one side of the float after it tilts causing the float to become relatively stable in the tilted or vertical orientation.

Contextual Details

The features of items used in conjunction with the floats described herein will first be described to provide context and to aid the discussion of the floats.

Liquid

The floats discussed herein are configured to float on a liquid. The liquid may be any currently known or later developed type of liquid, such as water, waste water reservoirs, industrial chemicals in liquid form, or other liquid compositions.

In the present document, an external liquid 111 having an external liquid surface 110 is described for discussing the orientation of the novel floats discussed herein. The reader will understand that external liquid surface 110 will often lie in a substantially horizontal plane, but is subject to local perturbations from waves, turbulence, and wind. Thus, the liquid surface extends in a substantially horizontal plane when the liquid surface is calm and deviates from the horizontal plane when subject to turbulent forces.

Float Embodiment One

With reference to FIGS. 1-9, a first example of a float, float 100, will now be described. Float 100 includes a central chamber 102, a peripheral chamber set 104, a ballast matter 108, and a linking recess 140. In some examples, the float includes fewer, additional, or alternative features than shown in FIGS. 1-9. For example, some float examples do not include a linking recess as depicted in FIGS. 1-9.

Float 100 is buoyant and configured to float on an external liquid surface 110 in a substantially horizontal plane. The amount of buoyancy of the float may be selected based on the volume of gas or other material providing buoyancy that is contained within the float in conjunction with the weight of the float. Additionally or alternatively, the amount of buoyancy may be selected by how much ballast matter is contained within the float or contained within external channels defined on the float. The amount of buoyancy of the float may control its depth in external liquid 111. Selecting a buoyancy amount that partially submerges the float may increase the float's stability and resistance to tipping.

Central Chamber

Figure 6:
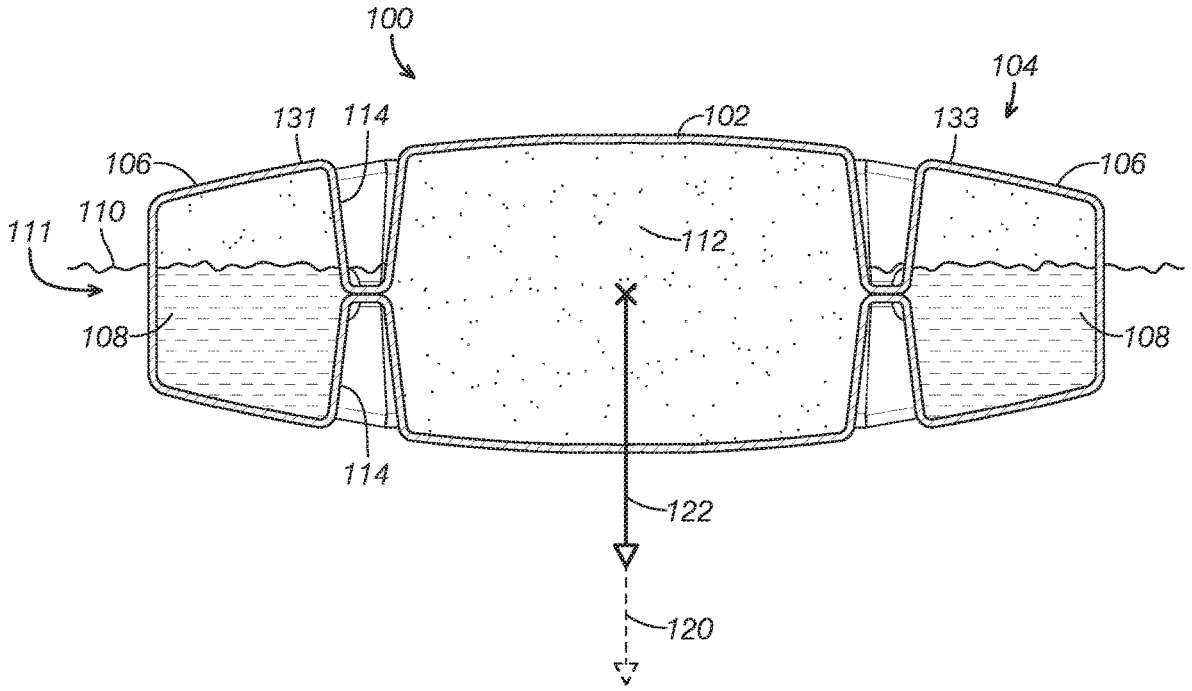
FIG. 6 is a cross section view of the float shown in FIG. 1 depicting ballast matter in the three sub-chambers, the central chamber containing a volume of air, the float floating on the external liquid surface in a substantially horizontal orientation, an arrow denoting the center of gravity of the float pointing downwards at the geometric center of the float, and an arrow denoting the geometric center of the float pointing downwards inline with the center of gravity arrow.
Figure 7:
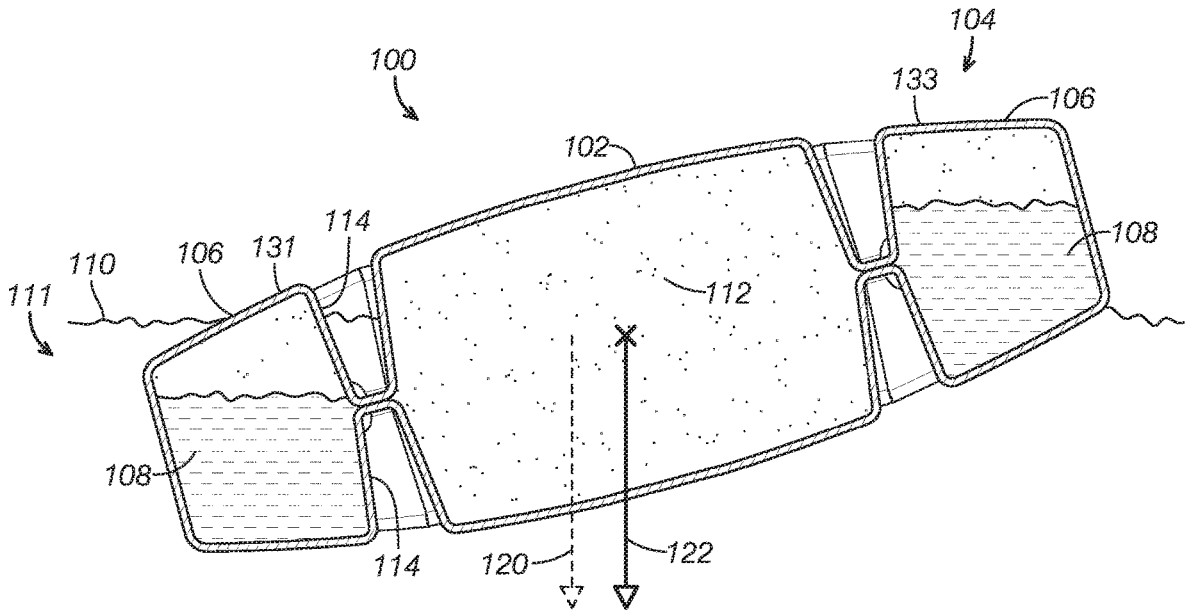
FIG. 7 is a cross section view of the float shown in FIG. 6 depicting the float floating on the external liquid surface in an orientation tilted from horizontal, the ballast matter in the sub-chambers maintaining a horizontal liquid surface, an arrow denoting the center of gravity of the float pointing downwards slightly offset from the geometric center of the float, and an arrow denoting the geometric center of the float pointing downwards at the geometric center of the float.
Figure 8:
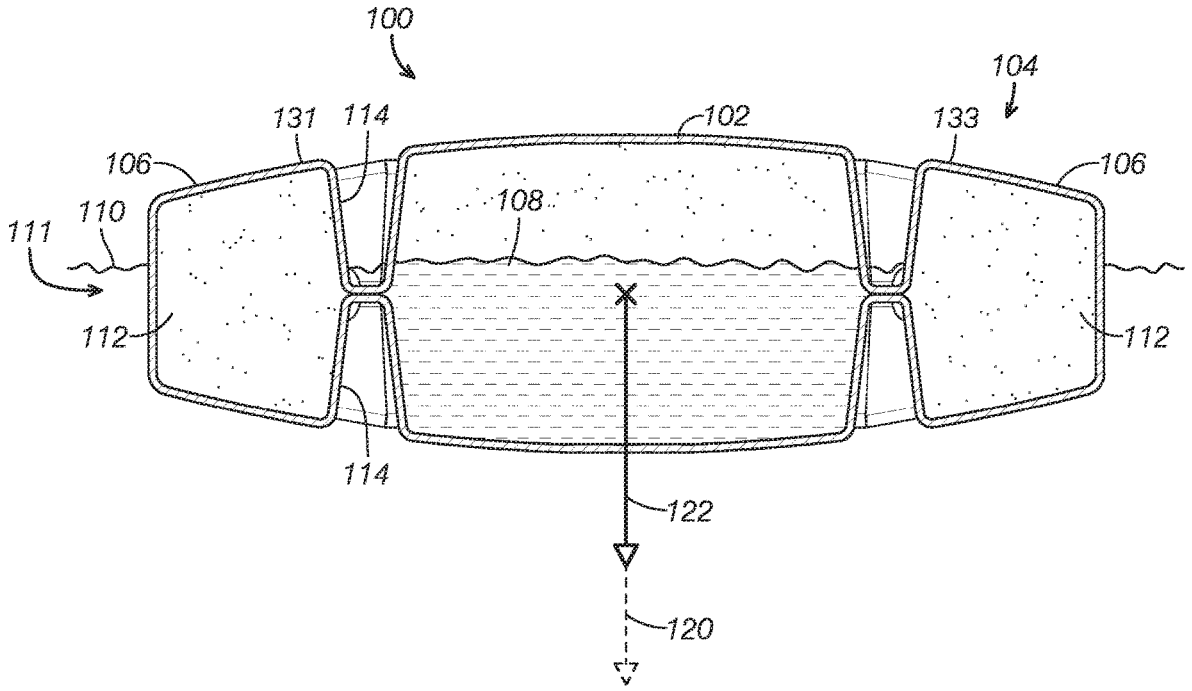
FIG. 8 is a cross section view of the float shown in FIG. 1 depicting ballast matter in the central chamber, the three sub chambers containing a volume of air, the float floating on the external liquid surface in a substantially horizontal orientation, an arrow denoting the center of gravity of the float pointing downwards at the geometric center of the float, and an arrow denoting the geometric center of the float pointing downwards in line with the center of gravity arrow.
Figure 9:
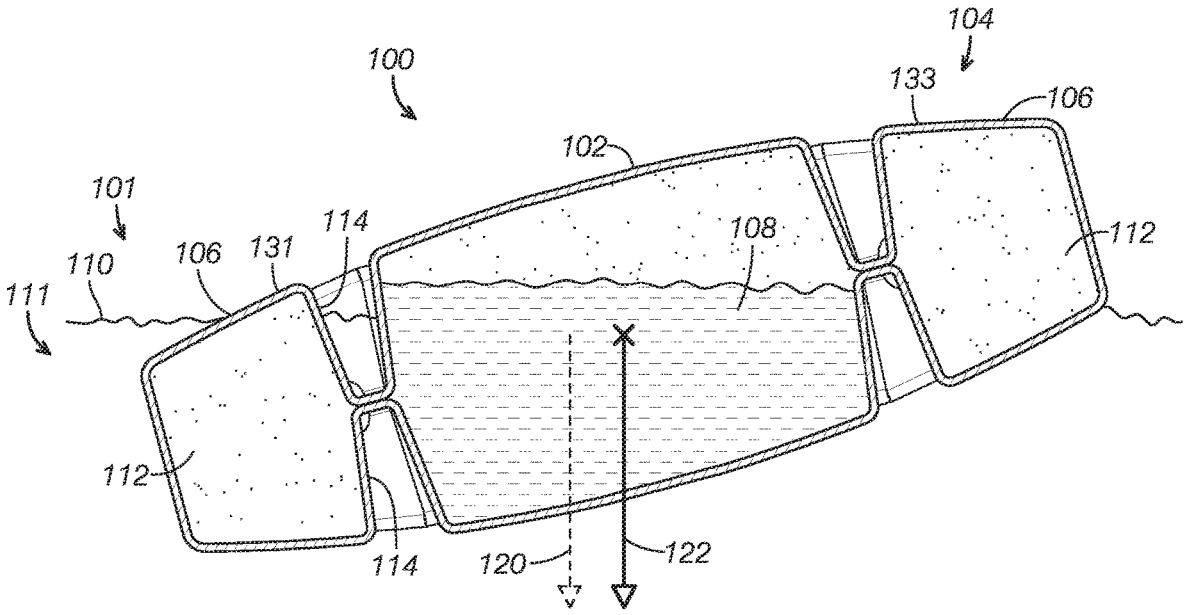
FIG. 9 is a cross section view of the float shown in FIG. 8 depicting the float floating on the external liquid surface in an orientation tilted from horizontal, the ballast matter in the central chamber maintaining a horizontal liquid surface, an arrow denoting the center of gravity of the float pointing downwards slightly offset from the geometric center of the float, and an arrow denoting the geometric center of the float pointing downwards at the geometric center of the float.

Central chamber 102 functions to contain either ballast matter 108, as depicted in FIGS. 8 and 9, or a sealed volume of gas 112, as depicted in FIGS. 6 and 7. In some examples, the central chamber additionally or alternatively contains foam or other material with selected buoyancy attributes.

In the configuration shown in FIGS. 6 and 7, central chamber 102 contains a sealed volume of gas 112 to provide buoyancy to float 100. The size of the central chamber may be selected to contain a desired volume of sealed gas to provide a desired amount of buoyancy.

In the configuration shown in FIGS. 8 and 9, ballast matter 108 is disposed exclusively in central chamber 102 to help maintain a center of gravity 120 of float 100 near a geometric center 122 of float 100. The reader can see in FIG. 8 that center of gravity 120 overlies geometric center 122 when float 100 is horizontally aligned. With reference to FIG. 9, the reader can see that center of gravity 120 shifts laterally relative to geometric center 122 by a relatively small amount when float 100 tilts in response to ballast matter 108 shifting to the downward tilting side in central chamber 102. However, constraining ballast matter 108 in central chamber 102 significantly reduces how much center of gravity 120 shifts relative to geometric center 122 as compared to conventional floats where ballast matter may move unconstrained throughout the float.

Ballast matter 108 contained within central chamber 102 keeps center of gravity 120 relatively close to geometric center 122. Keeping center of gravity 120 relatively close to geometric center 122 limits the tendency of float 100 to tilt relative to a horizontal plane corresponding to the generally horizontal plane of external liquid surface. Maintaining center of gravity 120 relatively close to geometric center 122 also functions to encourage float 100 to return to a horizontal orientation after temporarily deviating from the horizontal orientation. Expressed another way, keeping center of gravity 120 relatively close to geometric center 122 helps float 100 right itself back to a horizontal alignment after being tilted due to waves, wind, or other forces.

In the example shown in FIGS. 8 and 9, the reader can see that ballast matter 108 fills a majority of central chamber 102. In some examples, more or less ballast matter is contained in the central chamber. The amount of ballast matter 108 contained within central chamber 102 may be selected to provide a desired amount of buoyancy for float 100 and/or to provide a desired degree of tilt resistance and self-leveling.

Figure 2:
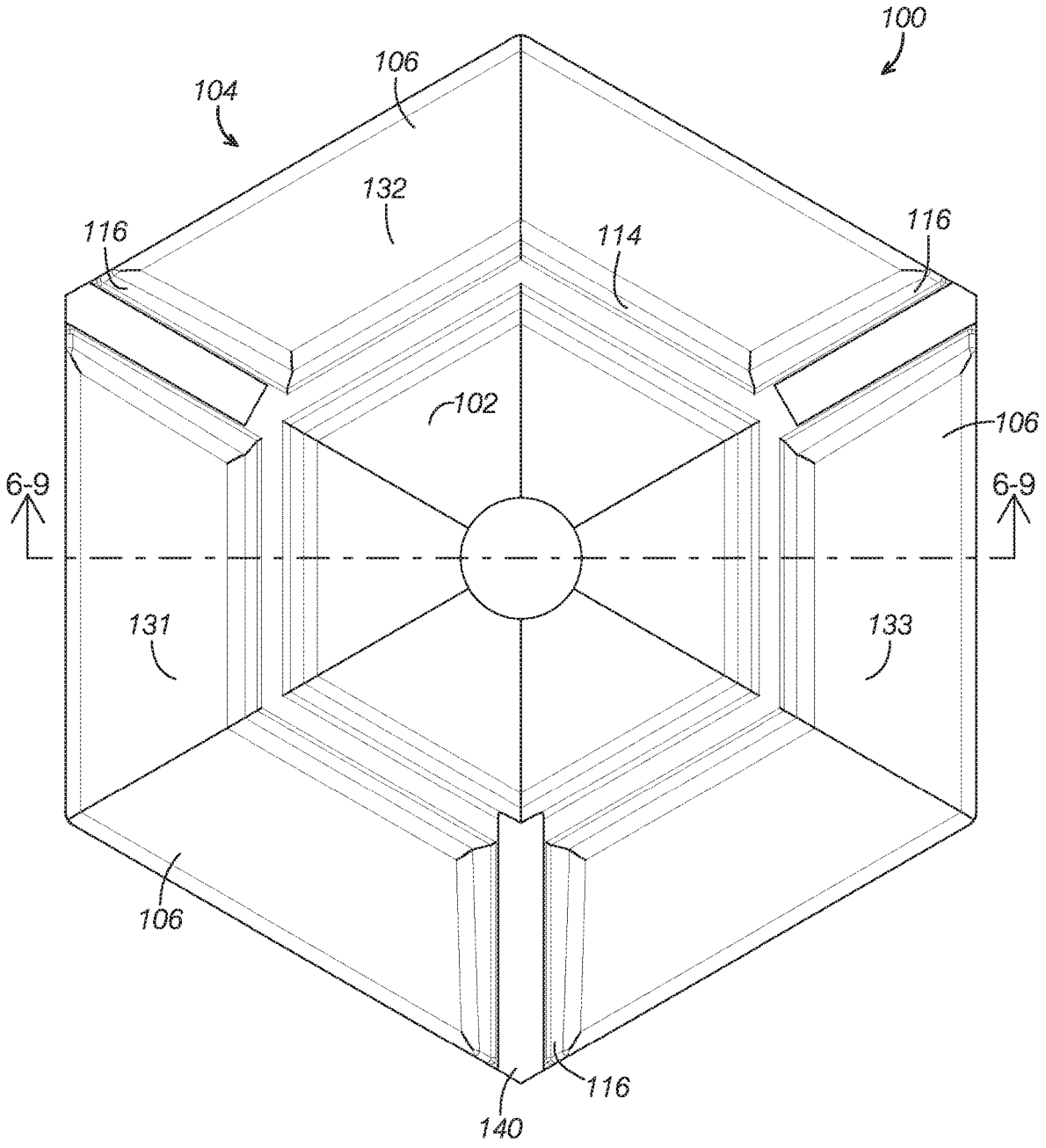
FIG. 2 is a top plan view of the float shown in FIG. 1.
Figure 3:
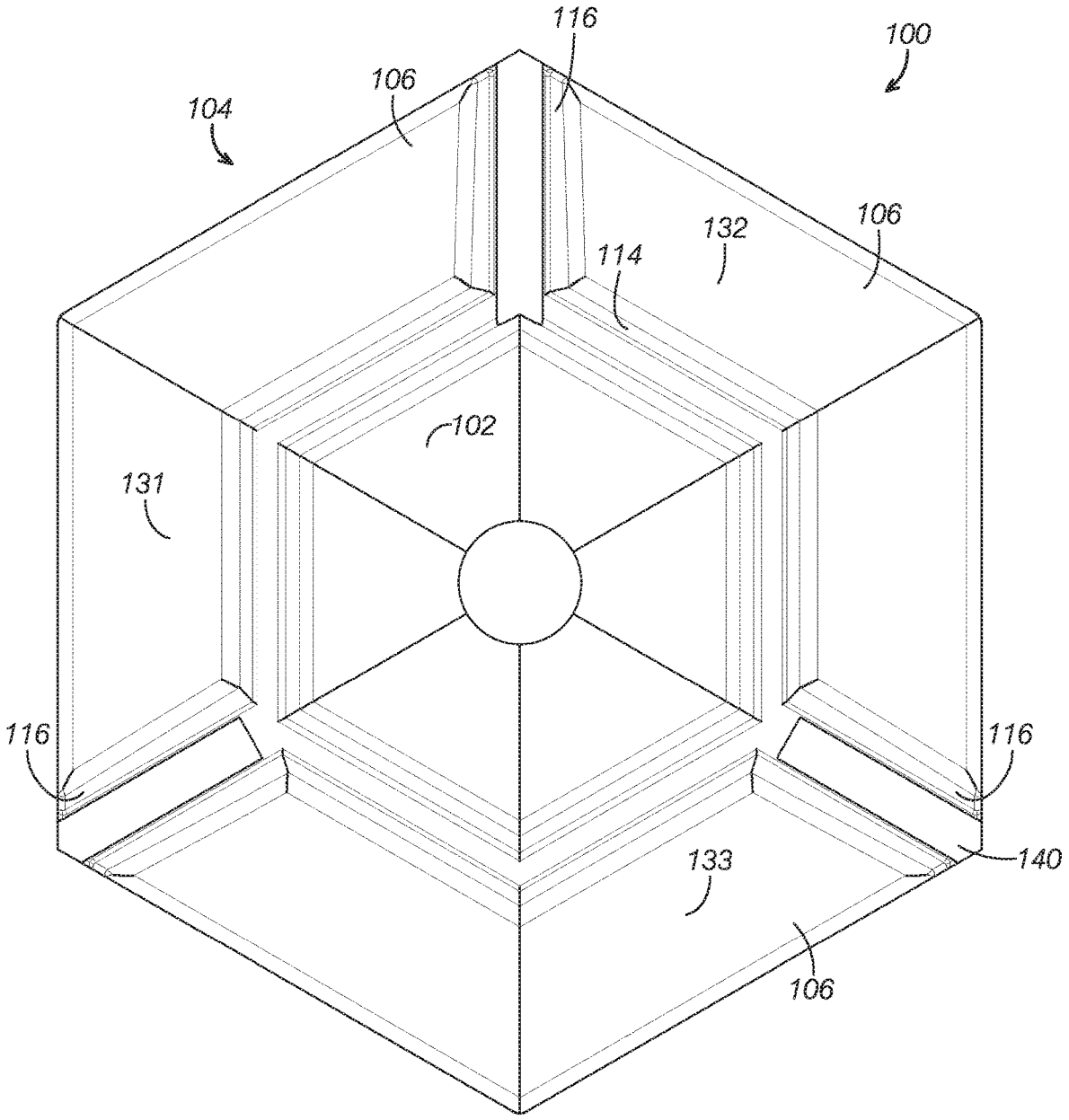
FIG. 3 is a bottom plan view of the float shown in FIG. 1.
Figure 4:
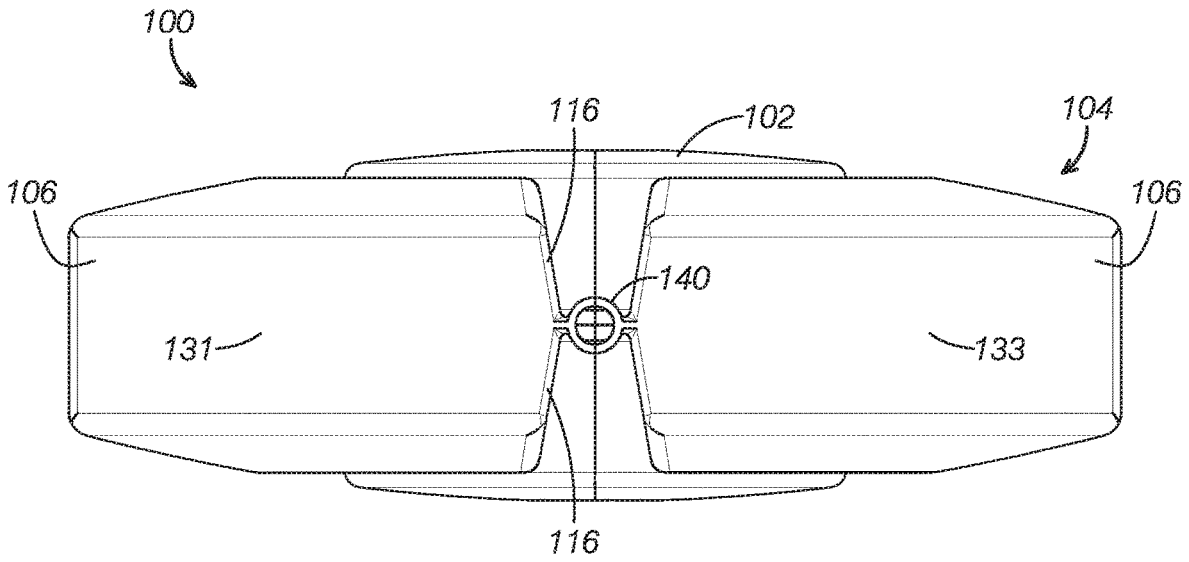
FIG. 4 is a front side elevation view of the float shown in FIG. 1.
Figure 5:
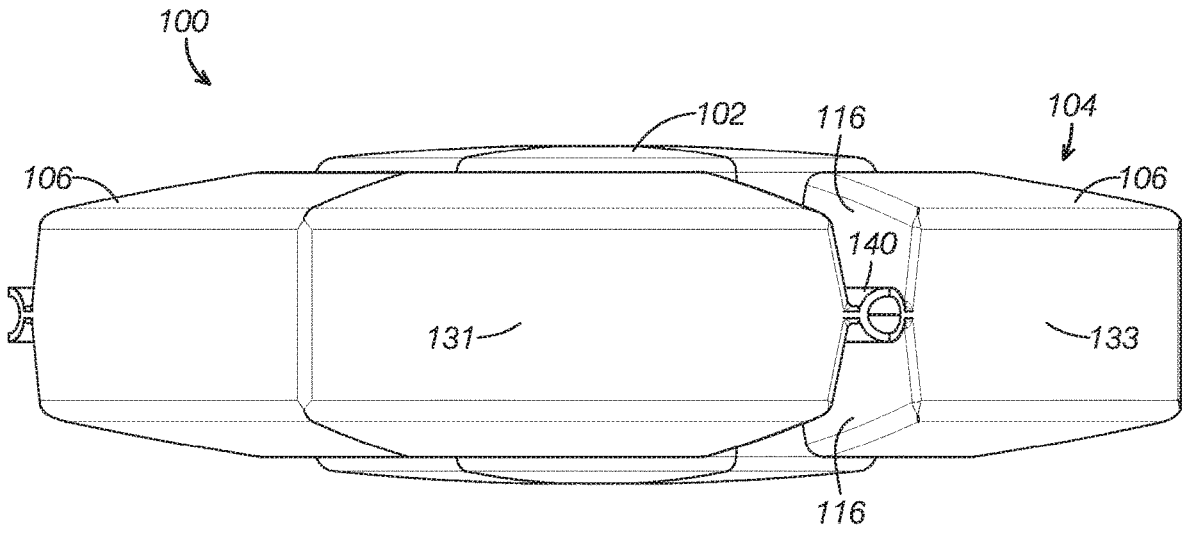
FIG. 5 is a right side elevation view of the float shown in FIG. 1.

As shown in FIGS. 1-3, central chamber 102 resembles a six sided regular polygon from above and below with a sidewall connecting the top and bottom portions. However, the central chamber may adopt any suitable shape. For example, the central chamber may be cylindrical, cubical, spherical, egg shaped, or a variety of other regular and irregular shapes.

The central chamber will often be symmetrical about the horizontal plane for stability. In the example shown in FIGS. 1-9, float 100 is symmetrical relative to the horizontal plane. However, symmetry about the horizontal plane is not required for the central chamber or for the float as a whole.

In some examples, the top or the bottom portion of the central chamber is intentionally selected to have a smaller volume to encourage the float to float on a particular side. For example, when the central chamber contains ballast matter and the bottom portion has a smaller volume, the float will tend to float with the bottom portion oriented above the liquid level and the top portion of the central chamber with a larger volume oriented below the liquid level. Conversely, when the central chamber contains a sealed gas or other material selected to provide buoyancy to the float, the float will tend to float with the portion having a larger volume oriented above the liquid level and the portion with the smaller volume oriented below the liquid level.

The central chamber, along with the other components of the float, may be formed from an injection molding process or a blow molding process. Any currently known or later developed process for forming the central chamber and other components of the float may be used.

In the examples shown in FIGS. 1-9, central chamber 102 is formed from plastic. In other examples, additional or other materials are used to form the central chamber. The central chamber may be formed from any currently known or later developed material or combination of materials.

Peripheral Chamber Set

Similar to central chamber 102, peripheral chamber set 104 functions to contain either ballast matter 108 or sealed volume of gas 112. In cooperation with central chamber 102, peripheral chamber set 104 functions to define an inner channel 114 between peripheral chamber set 104 and central chamber 102. Further, peripheral chamber set 104 functions to define inlet channels 116.

In the example depicted in FIGS. 8 and 9, peripheral chamber set 104 contains sealed volume of gas 112 to increase the buoyancy of float 100. In some examples, the peripheral chamber set additionally or alternatively contains foam or other materials with selected buoyancy attributes. The size of the peripheral chamber set may be selected to contain a desired volume of sealed gas to provide a desired amount of buoyancy.

In the example depicted in FIGS. 6 and 7, peripheral chamber set 104 contains ballast matter 108 in sub-chambers 106. In some examples, such as shown in FIGS. 6 and 7, ballast matter 108 is disposed exclusively in sub-chambers 106. In other examples, the ballast matter is disposed in both the sub-chambers and in the central chamber concurrently.

The self-leveling operating principal of ballast matter 108 in peripheral chamber set 104 is substantially similar to how ballast matter 108 functions in central chamber 102. In both instances, ballast matter 108 functions to maintain center of gravity 120 near geometric center 122.

As can be seen in FIGS. 1-5, peripheral chamber set 104 is disposed around central chamber 102 in a substantially common plane with central chamber 102. The reader can see in FIGS. 1-9 that peripheral chamber set 104 defines circumferentially spaced sub-chambers 106. In the present example, sub-chambers 106 are spaced equal angular distances around the circumference of float 100. However, in other examples, the sub-chambers are spaced around the circumference of the float at different angular distances.

In the example shown in FIGS. 1-9, peripheral chamber set 104 defines three sub-chambers: first sub-chamber 131, second sub-chamber 132, and third sub-chamber 133. In other examples, the peripheral chamber set defines fewer or additional sub-chambers. For example, the peripheral chamber set may define two sub-chambers, four sub-chambers, or five or more sub-chambers.

In the example shown in FIGS. 6 and 7, ballast matter 108 is disposed in each of the three sub-chambers 106. In other examples, a subset of the sub-chambers contain ballast matter and the other sub-chambers include a sealed volume of air and/or a foam or other material selected for desired buoyancy attributes.

Sub-chambers 106 are discrete from each other and not in fluid communication with each other. Being discrete chambers avoids ballast matter 108 collecting on one side of float 100 and shifting center of gravity 120 towards that side a significant distance away from geometric center 122 when float 100 tips in response to waves, wind, or other external forces. Avoiding center of gravity 120 shifts a significant distance away from geometric center 122 encourages float 100 to maintain a generally horizontal orientation and to return to a generally horizontal orientation when tilted by external forces.

In the example shown in FIGS. 6 and 7, the reader can see that ballast matter 108 fills a majority of sub-chambers 106. In some examples, more or less ballast matter is contained in the sub-chambers. The amount of ballast matter 108 contained within sub-chambers 106 may be selected to provide a desired amount of buoyancy for float 100 and/or to provide a desired degree of tilt resistance and self-leveling.

As shown in FIGS. 1-3 and 5-9, peripheral chamber set 104 is radially spaced from central chamber 102. The radial spacing defines an inner channel 114 between peripheral chamber set 104 and central chamber 102. As shown in FIGS. 1-5, the circumferentially spacing of sub-chambers 106 defines inlet channels 116 between sub-chambers 106. Inlet channels 116 are in fluid communication with inner channel 114.

As shown in FIGS. 1 and 6-9, central chamber 102, peripheral chamber set 104, inner channel 114, and the inlet channels 116 cooperate to maintain float 100 in a partially submerged position 101 relative to external liquid surface 110. Maintaining float 100 in partially submerged position 101 is accomplished by receiving external liquid 111 in inner channel 114 to counteract the buoyancy of float 100 from its enclosed volume of gas in either central chamber 102 or peripheral chamber set 104. Counteracting the buoyancy of float 100 functions to partially submerge it, which increases its stability and resistance to tipping in external liquid 111. External liquid 111 is received in inner channel 114 via inlet channels 116.

In the examples shown in FIGS. 1-9, sub-chambers 106 are formed from plastic. In other examples, additional or other materials are used to form the sub-chambers. The sub-chambers may be formed from any currently known or later developed material or combination of materials.

Ballast Matter

Ballast matter 108 functions to counteract the buoyancy of float 100 by a desired degree. Counteracting the buoyancy of float 100 causes float 100 to sit lower in external liquid 111 for stability and resistance to tipping. As described above, ballast matter 108 also functions to keep center of gravity 120 relatively close to geometric center 122 when float 100 tilts due to external forces, such as waves or wind. Expressed another way, ballast matter 108 operates to maintain center of gravity 120 proximate to geometric center 122 when float 100 tilts relative to the horizontal plane In the examples shown in FIGS. 1-9, ballast matter 108 is water. In other examples, other matter, such as fluids other than water, are selected for the ballast matter. In some examples, the ballast matter is a solid material, such as sand, gravel, dirt, or other inert substance. The ballast matter may be any currently known or later developed substance or combination of substances suitable for counteracting the buoyancy of the float.

As shown in FIGS. 6-9, ballast matter 108 may be disposed in either central chamber 102 or sub-chambers 106 of peripheral chamber set 104. In some examples, such as shown in FIGS. 6 and 7, ballast matter 108 is disposed exclusively in peripheral chamber set 104. In other examples, such as shown in FIGS. 8 and 9, ballast matter 108 is disposed exclusively in central chamber 102. In certain examples, the ballast matter is disposed in both the central chamber and the peripheral chamber set.

Linking Recess

The reader can see in FIGS. 1-5 that float 100 includes a linking recess 140 to facilitate linking floats together. In some examples, the floats include a linking member complementarily configured with the linking recess. The linking member inserts into linking recess 140 of float 100 and into a corresponding linking recess of an adjacent float. The linking member and the linking recess cooperate to hold the linking member in the linking recesses by frictional engagement between the linking member and the linking recesses.

The linking recess is an optional feature not present in all examples of the float.

Additional Embodiments

With reference to the figures not yet discussed, the discussion will now focus on additional float embodiments. The additional embodiments include many similar or identical features to float 100. Thus, for the sake of brevity, each feature of the additional embodiments below will not be redundantly explained. Rather, key distinctions between the additional embodiments and float 100 will be described in detail and the reader should reference the discussion above for features substantially similar between the different float examples.

Second Embodiment

Figure 10:
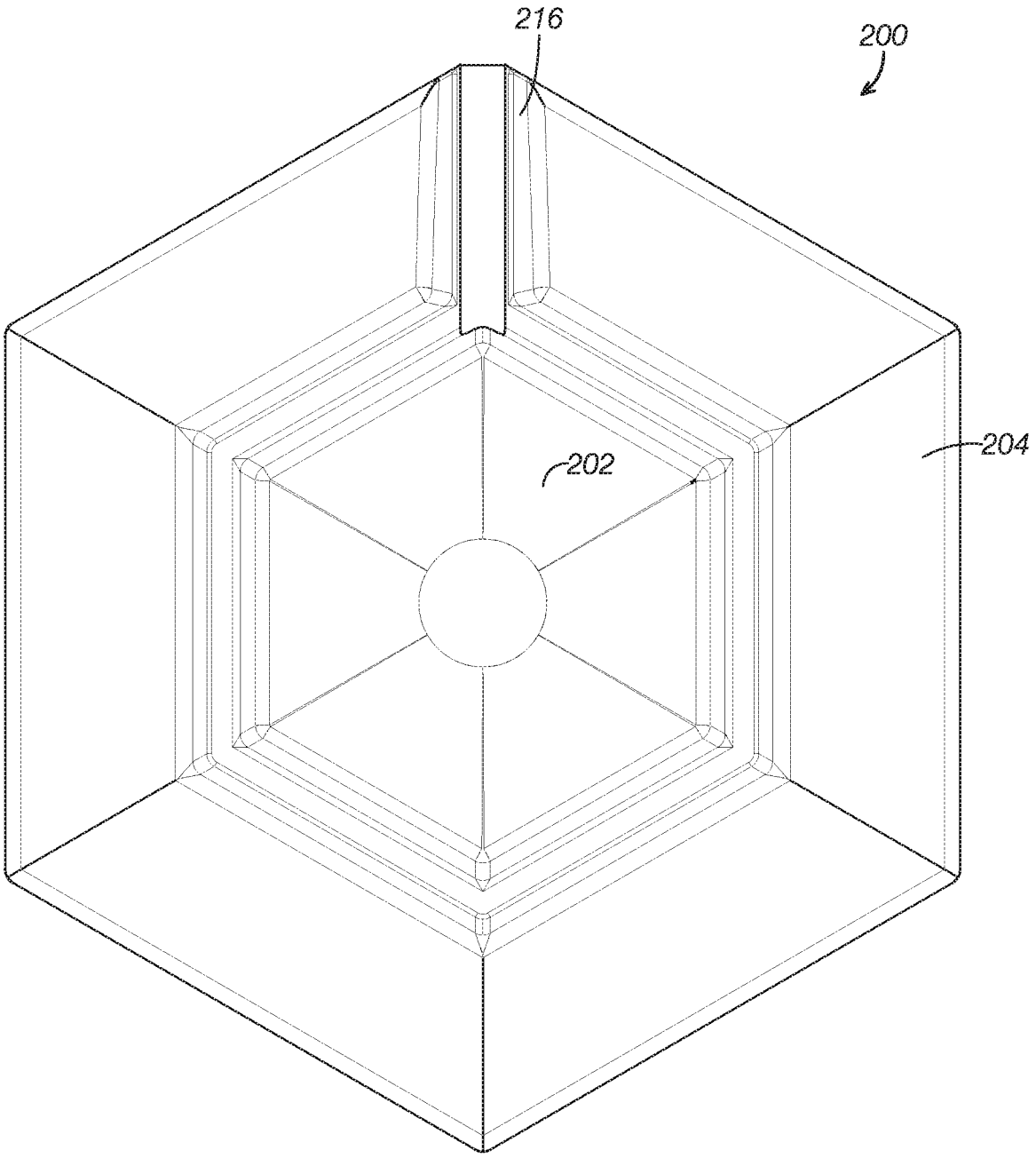
FIG. 10 is a top view of a second example of a float where the float includes a central chamber and a single peripheral chamber.

Turning attention to FIG. 10, a second example of a float, float 200, will now be described. As can be seen in FIG. 10, float 200 includes a central chamber 202, a peripheral chamber 204, and ballast matter (not pictured) in central chamber 202.

A distinction between float 200 and float 100 is that peripheral chamber 204 is a single chamber rather than including three sub-chambers 106 in peripheral chamber set 104. The reader can see in FIG. 10 that peripheral chamber 204 does not extend fully around the circumference of float 200 and defines an inlet channel 216 between terminal ends of peripheral chamber 204. Another distinction between float 200 and float 100 is that the ballast matter in float 200 is sand as compared to ballast matter 108 being water in float 100.

The disclosure above encompasses multiple distinct inventions with independent utility. While each of these inventions has been disclosed in particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A float, comprising:

a central chamber;

a peripheral chamber set disposed around the central chamber in a substantially common plane with the central chamber, the peripheral chamber set defining circumferentially spaced sub-chambers;

a ballast matter disposed in either the central chamber or the sub-chambers of the peripheral chamber set;

wherein:

the float is buoyant and configured to float on an external liquid surface in a substantially horizontal plane;

the ballast matter operates to maintain a center of gravity of the float proximate to the geometric center of the float when the float tilts relative to the horizontal plane.

2. The float of claim 1, wherein the sub-chambers are spaced equal angular distances around the circumference of the float.

3. The float of claim 2, wherein the peripheral chamber set defines three sub-chambers.

4. The float of claim 3, wherein the ballast matter is disposed exclusively in the sub-chambers.

5. The float of claim 4, wherein the ballast matter is disposed in each of the three sub-chambers.

6. The float of claim 1, wherein the ballast matter is disposed exclusively in the central chamber.

7. The float of claim 1, wherein the sub-chambers are discrete from each other and not in fluid communication with each other.

8. The float of claim 7, wherein the ballast matter is disposed in each of the sub-chambers.

9. The float of claim 1, wherein:

the ballast matter is disposed in the sub-chambers; and the central chamber contains a sealed volume of gas to provide buoyancy.

10. The float of claim 1, wherein:

the ballast matter is disposed in the central chamber; and the sub-chambers contain a sealed volume of gas to provide buoyancy.

11. The float of claim 1, wherein the ballast matter fills at least a majority of either the central chamber or the sub-chambers of the peripheral chamber set.

12. The float of claim 1, wherein the central chamber is formed from plastic.

13. The float of claim 12, wherein the sub-chambers are formed from plastic.

14. The float of claim 13, wherein the float is formed from an injection molding process or a blow molding process.

15. The float of claim 1, wherein the peripheral chamber set is radially spaced from the central chamber to define an inner channel between them.

16. The float of claim 15, wherein the circumferentially spacing of the sub-chambers defines inlet channels between the sub-chambers.

17. The float of claim 16, wherein the inlet channels are in fluid communication with the inner channel.

18. The float of claim 17, wherein the central chamber, the peripheral chamber set, the inner channel, and the inlet channels cooperate to maintain the float in a partially submerged position relative to the external liquid surface by receiving external liquid in the inner channel via the inlet channels to counteract the buoyancy of the float and partially submerge the float.

19. The float of claim 17, wherein the float is symmetrical relative to the horizontal plane.

20. A float, comprising:

a central chamber;

a peripheral chamber set disposed around and spaced from the central chamber in a substantially common plane with the central chamber, the peripheral chamber set defining circumferentially spaced sub-chambers that are spaced equal angular distances around the circumference of the float, the peripheral chamber set and the central chamber defining an inner channel in the space between them, the circumferentially spacing of the sub-chambers defining inlet channels between the sub-chambers in fluid communication with the inner channel;

a ballast matter disposed in either the central chamber or the sub-chambers of the peripheral chamber set;

wherein:

the float is buoyant and configured to float on an external liquid surface in a substantially horizontal plane;

the ballast matter operates to maintain a center of gravity of the float proximate to the geometric center of the float when the float tilts relative to the horizontal plane.

* * * * *